US010246849B2

(12) United States Patent
Marek et al.

(10) Patent No.: US 10,246,849 B2
(45) Date of Patent: Apr. 2, 2019

(54) IMPLEMENT SYSTEM WITH BUCKET HAVING TORSIONAL SUPPORT, AND MACHINE HAVING SAME

(71) Applicant: Caterpillar Underground Mining Pty. Ltd., South Burnie (AU)

(72) Inventors: John Marek, Sugar Grove, IL (US); Kamesh Gopal, Nanganallur (IN)

(73) Assignee: Caterpillar Underground Mining Pty Ltd, Burnie (AU)

( * ) Notice: Subject to any disclaimer, the term of this patent is extended or adjusted under 35 U.S.C. 154(b) by 370 days.

(21) Appl. No.: 15/274,737

(22) Filed: Sep. 23, 2016

(65) Prior Publication Data

US 2018/0087236 A1 Mar. 29, 2018

(51) Int. Cl.
*E02F 3/40* (2006.01)
*E02F 3/38* (2006.01)

(52) U.S. Cl.
CPC . *E02F 3/40* (2013.01); *E02F 3/38* (2013.01)

(58) Field of Classification Search
CPC ..... E02F 3/40; E02F 3/401
USPC ..... 414/727, 722
See application file for complete search history.

(56) References Cited

U.S. PATENT DOCUMENTS

| | | | | |
|---|---|---|---|---|
| 3,109,248 | A * | 11/1963 | Vos | E02F 3/40 37/408 |
| 3,913,768 | A * | 10/1975 | Grooss | E02F 3/401 414/711 |
| 4,395,193 | A * | 7/1983 | Christensen | E02F 3/401 37/444 |
| 4,459,768 | A | 7/1984 | Albrecht | |
| 4,477,987 | A * | 10/1984 | Stecklein | E02F 3/401 37/444 |
| 4,633,601 | A | 1/1987 | Fleck et al. | |
| 7,617,619 | B2 | 11/2009 | Cox | |
| 8,069,593 | B2 | 12/2011 | McClallen et al. | |
| 9,366,006 | B2 * | 6/2016 | Morinaga | E02F 3/34 |
| 9,719,229 | B2 * | 8/2017 | Bandou | E02F 3/34 |
| 9,732,494 | B2 * | 8/2017 | Honda | E02F 3/40 |
| 2014/0119869 | A1 * | 5/2014 | France | E02F 3/40 414/715 |
| 2014/0137444 | A1 * | 5/2014 | Srinivasa Rengan | E02F 3/964 37/444 |
| 2017/0037594 | A1 * | 2/2017 | Wada | E02F 3/40 |

FOREIGN PATENT DOCUMENTS

| | | |
|---|---|---|
| CN | 85107742 | 4/1987 |
| JP | 5336865 | 11/2013 |

* cited by examiner

*Primary Examiner* — Gerald McClain
(74) *Attorney, Agent, or Firm* — Mattingly Burke Cohen & Biederman

(57) ABSTRACT

An implement system includes a linkage and a bucket coupled with the linkage and movable between a dump position and a racked position. The bucket has a torque tube assembly coupled to an outer surface to increase the bucket's torsional rigidity.

18 Claims, 4 Drawing Sheets

IMPLEMENT SYSTEM WITH BUCKET HAVING TORSIONAL SUPPORT, AND MACHINE HAVING SAME

TECHNICAL FIELD

The present disclosure relates generally to buckets for capturing and moving material, and more particularly to a torque tube support structure in a bucket, for providing increased strength and torsional rigidity.

BACKGROUND

Wheel loaders, track loaders, and other loading machines are equipped with buckets for the purposes of digging, loading, and transporting all manner of different materials. One particular type of loader, an underground loader, or load, haul, dump machine (LHD) is adapted to perform these functions at underground mining sites, which can present smaller, more confined work spaces than surface-level operations. Despite the varying logistical difficulties presented at various different mining sites, common to most is that materials in a loose state such as ore, rock and gravel must be moved around and often among different machines for transport and processing. One typical loader application at mine sites is the loading of blasted rock such as ore or overburden into a truck for disposal or transport to a processing site, or delivery of ore directly to a crusher. U.S. Pat. No. 4,633,601 to Fleck et al. is directed to a "shovel" that appears suitable for use in loader applications, and having pivotally interconnected back and front sections, and a torque tube apparently supported by bushings and structured for coupling the shovel to lift arms or the like in an implement system.

As suggested above, underground access is typically relatively limited, often resulting in narrow passageways, low clearances, and other difficulties. While loaders for surface mining and underground loaders share many features, underground loaders and related equipment are often purpose-built to meet the logistical challenges of underground excavation, typically having heavy planetary axles, four-wheel drive, and articulated steering to maximize maneuverability while having a narrower, longer, and lower profile in order to fit into tight access points. The latter of these adaptations extends not only to the body of underground loaders but also to its operational features such as the bucket and linkage.

SUMMARY OF THE INVENTION

In one aspect, a bucket for an implement system in a machine includes a bucket shell having an upper edge extending laterally between a left side wall and a right side wall, a roof section extending rearward from the upper edge, a lower edge oriented substantially parallel to the upper edge, a floor section extending rearward from the lower edge, and a back section connecting between the roof section and the floor section. The bucket further includes a plurality of mounting elements coupled to the back section of the bucket shell and structured for coupling the bucket to a linkage in the implement system. The bucket further including a torque tube assembly, the assembly having an elongate stiffener extending laterally between the left side wall and the right side wall. The stiffener includes a forward edge attached to the back section of the bucket shell at a first weld joint and a back edge attached to the back section of the bucket shell at a second weld joint, and a cross section forming a C-shape between the forward edge and the back edge In another aspect, an implement system for a machine includes a linkage, and a bucket having mounting elements coupling the bucket to the linkage, the bucket being movable relative to the linkage between a racked position and a dump position. The bucket further includes a bucket shell having an upper edge extending laterally between a right side wall and a left side wall, a roof section extending rearward from the upper edge, a lower edge, a floor section extending rearward from the lower edge, and a back section connecting between the roof section and the floor section and having the mounting elements located thereon. The bucket further includes a torque tube assembly, the assembly including an elongate stiffener extending laterally between the left side wall and the right side wall. The stiffener has a forward edge attached to the back section of the bucket shell at a first weld joint and a back edge attached to the back section of the bucket shell at a second weld joint, and a cross section forming a C-shape between the forward edge and the back edge.

In still another aspect, a machine includes a frame and an implement system coupled to the frame, and additionally includes a linkage and a bucket coupled to the linkage. The bucket includes a bucket shell having an upper edge extending laterally between a left side wall and a right side wall, a roof section extending rearward from the upper edge, a lower edge oriented substantially parallel to the upper edge, a floor section extending rearward from the lower edge, and a back section connecting between the roof section and the floor section. The bucket further includes a torque tube assembly having an elongate stiffener extending laterally between the left side wall and the right side wall, the stiffener including a forward edge attached to the back section of the bucket shell at a first weld joint and a back edge attached to the back section of the bucket shell at a second weld joint, and a cross section forming a C-shape between the forward edge and the back edge.

DETAILED DESCRIPTION

Figure 1:
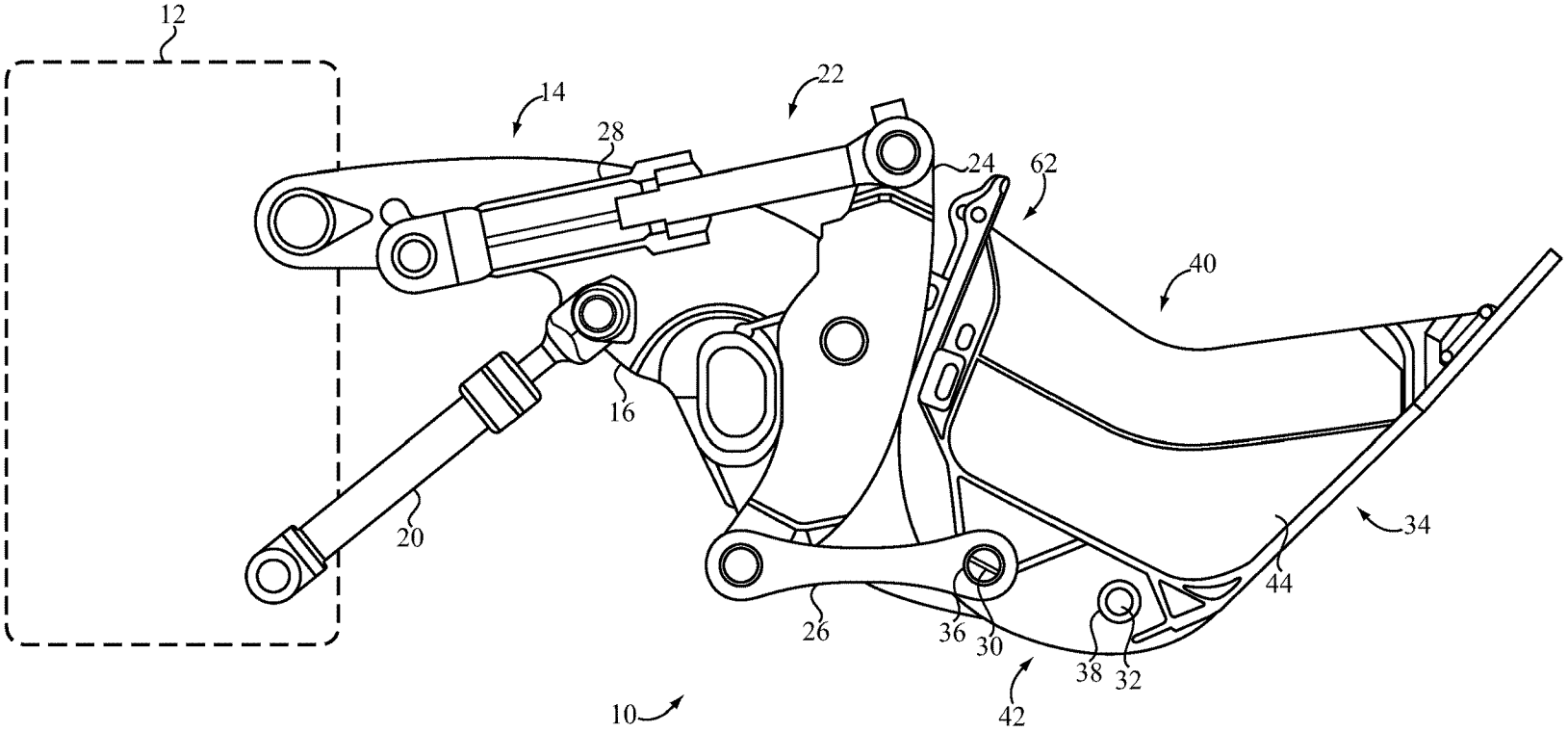
FIG. 1 is a side diagrammatic view of an implement system, according to one embodiment.

Referring to FIG. 1 there is shown an implement system 10 according to one embodiment, and coupled with or part of a machine 12. Machine 12 may include a wheel loader or a track loader, for example, including ground engaging propulsion elements in the nature of wheels or tracks in a conventional manner. It is contemplated that applications where a machine is used to capture and dump loose or moderately cohesive material from a pile will benefit from the teachings set forth herein, particularly in an underground mining application, however, the present disclosure is not strictly limited to any particular machine configuration or material or work application. Implement system 10 may include a linkage 14 having a lift arm 16 and a tilt lever assembly 22 pivotably coupled with lift arm 16. A bucket 34 including a plurality of mounting elements is pivotably coupled with lift arm 16 at a first location by way of a first group of the plurality of mounting elements 38 defining a lower pivot axis 32, and at a second location by way of a second group of the plurality of mounting elements 36 defining an upper pivot axis 30.

A lift actuator 20 is coupled between machine 12 and lift arm 16, and raises and lowers lift arm 16. A tilt actuator 28 is structured to pivot tilt lever 24 between a first position at which a connector 26 coupled with tilt lever 24 pivots bucket 34, toward a curled or racked position, approximately as shown in FIG. 1. Implement system 10 may be operated to capture, lift, and dump material, such as loose rock at the toe of a blast zone at a mine or within an underground mine at a draw point, into a truck or the like or deliver the load of material to an ore pass, for example. Bucket 34 is uniquely configured to have a relative high load capacity for its weight, thereby improving efficiency as further described herein. Bucket 34 has a front section 40, and a back section 42 shaped so as to enable bucket 34 and thus the material therein to be positioned relatively close to lift arm 16 when bucket 34 is racked approximately as shown in FIG. 1.

Figure 2:
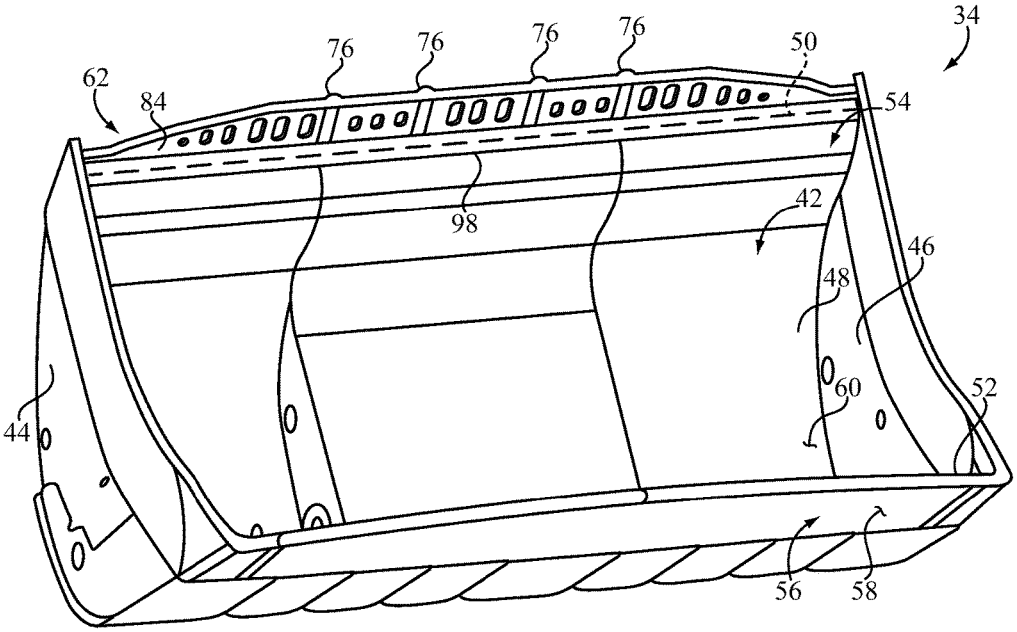
FIG. 2 is a front perspective view of a bucket, according to one embodiment.

Referring now also to FIG. 2, there is shown a view of bucket 34 illustrating certain additional features, including an upper edge 50 of a bucket shell 48 that extends laterally between a right side wall 44 and a left side wall 46. The terms "left" and "right" as used in the present disclosure are in relation to a viewpoint of a back side of bucket 34. If one were looking at bucket 34 from a front side, the terms "left" and "right" could be reversed. A lower edge 52 may be generally parallel to upper edge 50 and extends laterally between side walls 44, 46. Lower edge 52 of bucket 34 is the lowest-most edge of bucket 34 and may be formed by bucket shell 48 or any attachment to the front of floor section 56 of bucket shell 48 such as a cutting element. A forward plate 84 may be coupled to upper edge 50. A roof section 54 of bucket shell 48 extends rearward from upper edge 50, and a floor section 56 extends rearward from lower edge 52. Floor section 56 and roof section 54 may be positioned diagonally to each other and together with back section 42 to form bucket shell 48 having an inner surface 60 and an outer surface 58, with inner surface 60 forming a material-carrying volume structured to receive material. In the present instance, roof section 54 and floor section 56 are generally straight or linear and thus have linear profiles when viewed from the side, in other words where one is viewing one of side walls 44, 46 straight-on from a lateral side of bucket 34. Bucket 34 defines a bucket height dimension, generally a distance between upper edge 50 and floor section 56, and a bucket width dimension, generally a distance between right side wall 44 and left side wall 46. In the present embodiment, the bucket width dimension is about three times the bucket height dimension, or greater, although alternative embodiments may have a bucket with a different width dimension-to-height dimension ratio.

Figure 3:
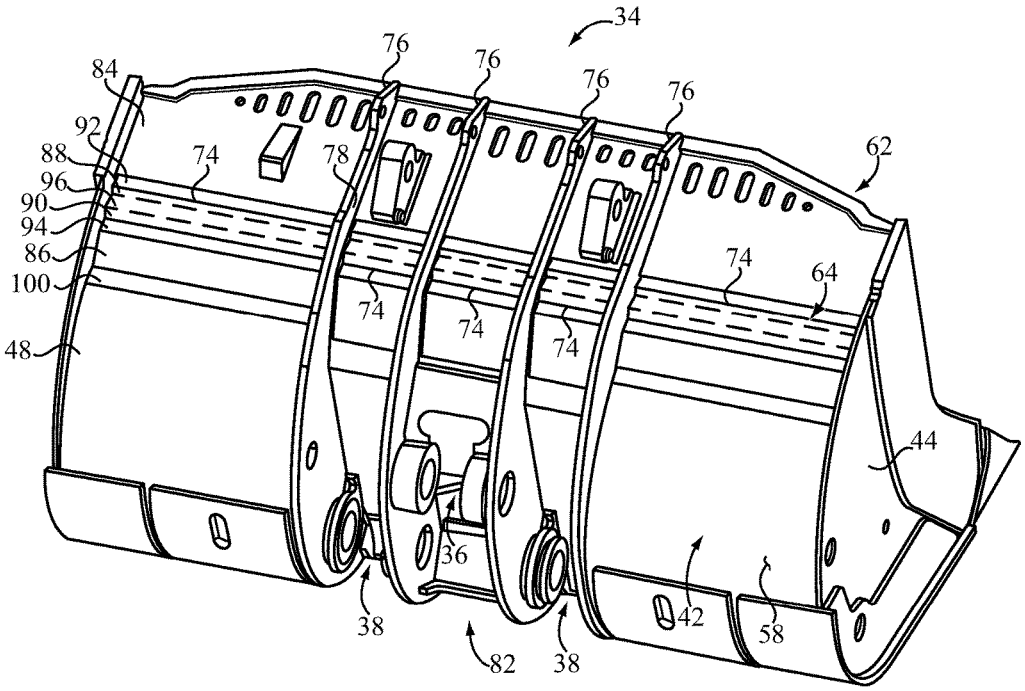
FIG. 3 is a back perspective view of a bucket, according to one embodiment.
Figure 4:
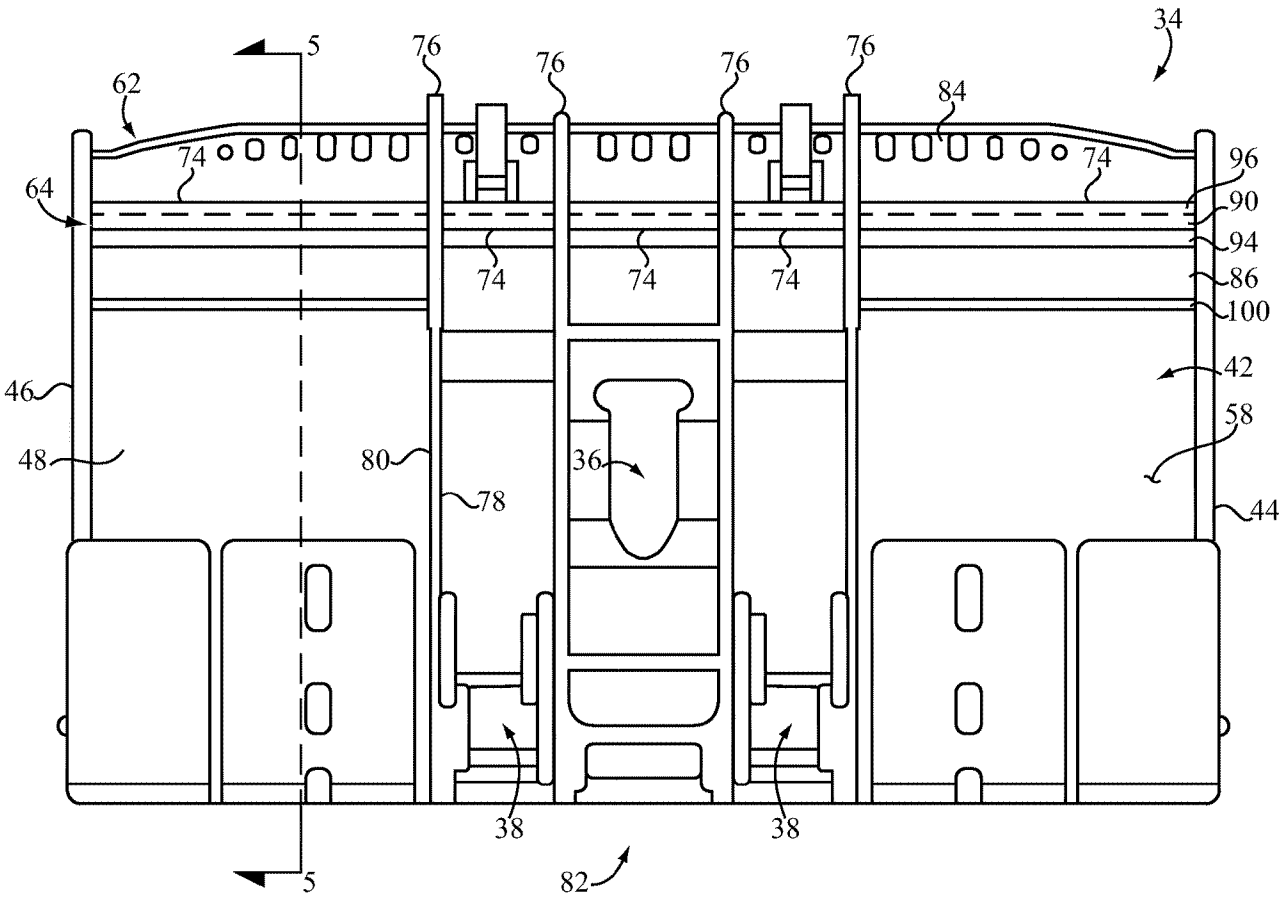
FIG. 4 is a back diagrammatic view of a bucket, according to one embodiment.

Referring now also to FIGS. 3 and 4, there are shown a perspective view and a diagrammatic view of bucket 34, illustrating a back section 42 of bucket shell 48 and side walls 44, 46 coupled to opposite sides of back section 42. Back section 42 is part of bucket shell 48, to which side walls 44, 46 are coupled. Also shown are upper mounting elements 36 positioned at least in part upon back section 42, and lower mounting elements 38 also positioned at least in part upon back section 42. Mounting elements 36, 38 pivotably couple bucket 34 to linkage 14. Upper pivot axis 30 may extend through upper mounting elements 36 whereas lower pivot axis 32 may extend through lower mounting elements 38. Linkage 14 may be equipped with hooks or the like, and structured to couple with pins supported within mounting elements 36, 38 in a generally conventional manner. It should be appreciated that while the side view illustrated of FIG. 1 depicts only a single lift arm, in a typical embodiment linkage 14 will include two parallel lift arms, with tilt lever assembly 22 being positioned generally between the parallel lift arms. In other embodiments, a single center lift arm might be used with two outer tilt lever assemblies, or still some other configuration.

FIGS. 3 and 4, and other drawings discussed herein, illustrate a torque tube assembly 62 of bucket 34 including an elongate support or stiffening member (hereinafter "stiffener") 64, a forward plate 84, and a back plate 86. Also shown are a plurality of hinge plates 76 which may be part of or functionally interact with other parts of torque tube assembly 62. Loading a material in bucket 34, such as driving into a pile, can result in an uneven application of loads laterally across bucket 34, resulting in torsional loads on various of the components of bucket 34, notably bucket shell 48 and components attaching bucket 34 to linkage 14. Torque tube assembly 62 is structured to stiffen and structurally support bucket 34 so as to limit undesirable effects of the torsional loading, such as deformation, damage and fatigue failure of bucket 34. Not only is bucket 34 made relatively stiff and strong for the mass of material used in constructing bucket 34, but certain aspects of the design and construction of bucket 34 limit concentration of stresses that are generated by the torsional or other loads, as further discussed herein.

Figure 6:
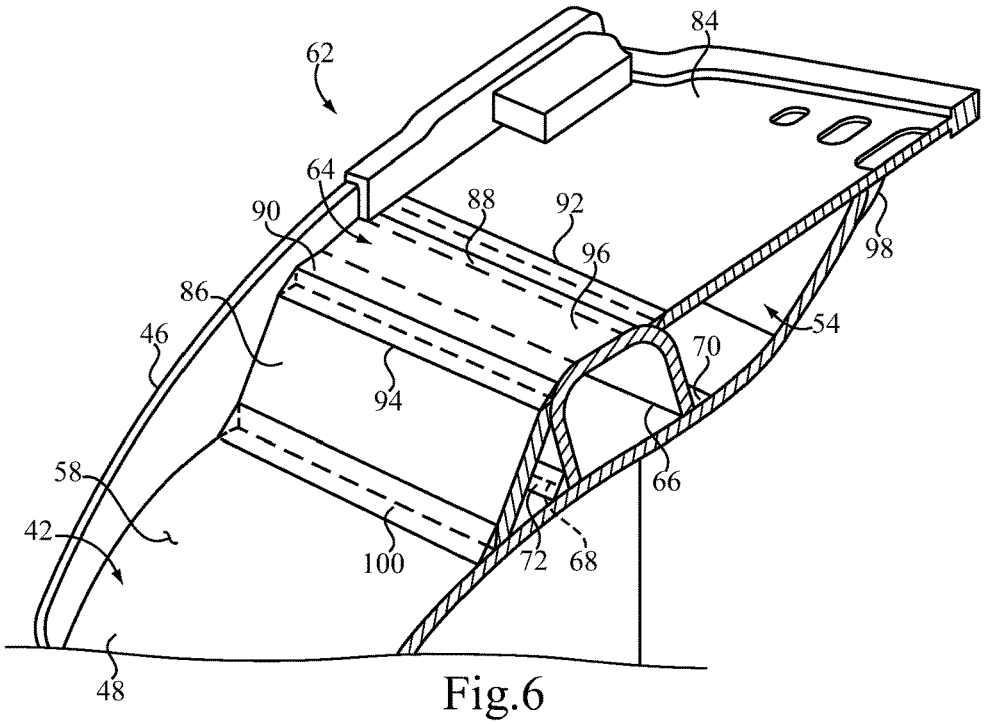
FIG. 6 is an enlarged view of a portion of the bucket shown in FIG. 5, according to one embodiment.

Stiffener 64 extends laterally across bucket shell 48, and is mounted and attached to outer surface 58 of bucket shell 48. In a practical implementation strategy, stiffener 64 includes a plurality of longitudinal stiffener segments 74 coupled to plurality of hinge plates 76 positioned at least partially within a cutout section 82 of back section 42, formed by an indented profile of back section 42. The stiffener 64 of the present embodiment is comprised of five stiffener segments 74 and, as illustrated in FIG. 6 and discussed herein, each having a forward edge 66 attached to back section 42 at a first weld joint 70 and a back edge 68 attached to back section 42 at a second weld joint 72, and a cross section forming a C-shape between forward edge 66 and back edge 68. Stiffener segments 74 may be constructed of 16 mm thick metal plates, such as steel or any other metal such as cast iron. Alternative embodiments may include a different number of stiffener segments 74, or a one-piece stiffener. Additionally, the thickness of stiffener segments 74 may be 15, 17, or 18 mm thick, or of any thickness. Hinge plates 76 may be positioned in an alternating arrangement with stiffener segments 74, with each hinge plate 76 including a first side 78 and a second side 80 welded to a first adjacent one of stiffener segments 74 and to a second adjacent one of stiffener segments 74, respectively. In addition to stiffener 64, other lateral components of torque tube assembly 62 such as forward plate 84 and back plate 86 may have a form analogous to stiffener 64 where each is segmented in a manner similar to stiffener 64. Stiffener segments 74 and hinge plates 76 are coupled such that stiffener 64 forms a continuous structure extending laterally across bucket shell 48 from right side wall 44 to left side wall 46. Stiffener 64 is also welded to side walls 44, 46, with the weld joints typically tracking the C-shaped cross section of stiffener 64, and thereby providing a curved attachment interface that assists in distributing stresses resulting from loads transferred between stiffener 64 and side walls 44, 46. Similar curving, C-shaped weld joints may attach stiffener segments 74 with hinge plates 76. Hinge plates 76 may have a plurality of mounting elements 36, 38 and may be coupled to back section 42 of bucket shell 48. In the illustrated embodiment, four hinge plates 76 are provided, with the inner two hinge plates 76 having upper mounting elements 36 and all four hinge plates 76 having lower mounting elements 38, with each of a first pair and a second pair of hinge plates 76 having a first lower mounting element and second lower mounting element, respectively.

Figure 5:
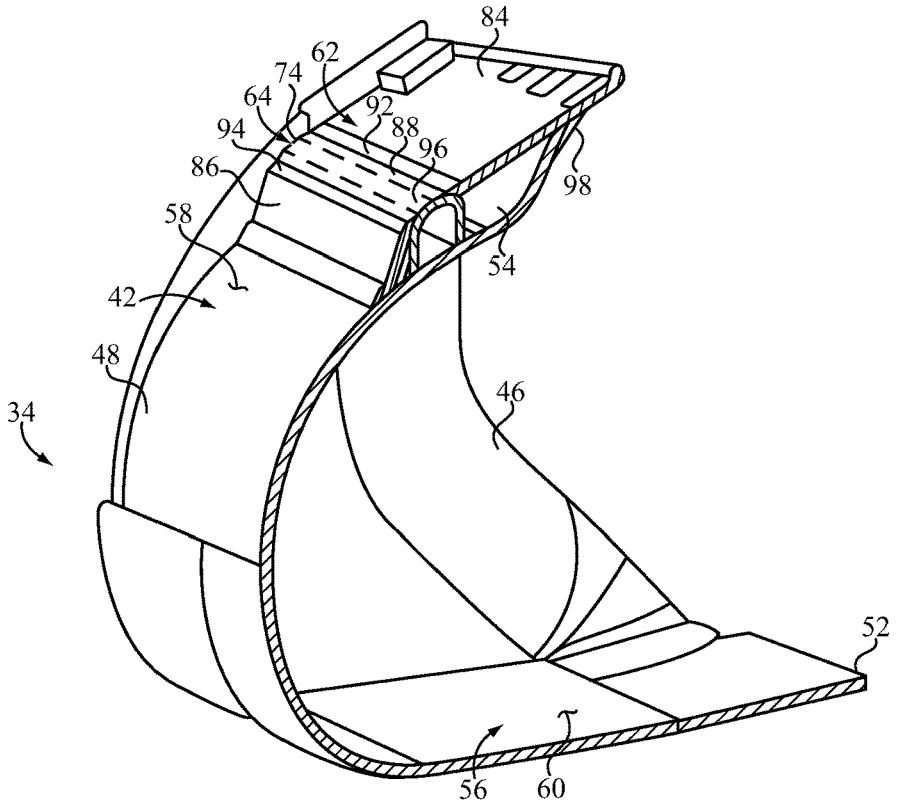
FIG. 5 is a sectioned side diagrammatic view of a bucket, according to one embodiment.

Referring now also to FIG. 5, there is shown a cross section view of bucket 34 along line 5-5 of FIG. 4. FIG. 5 illustrates additional features of torque tube assembly 62. It can be seen that stiffener 64 has a forward curve 88 and a rearward curve 90 by which forward plate 84 and back plate 86 may be coupled to stiffener 64, respectively. Referring now also to FIG. 6, there is shown an enlarged view of torque tube assembly 62 of FIG. 5. As noted above, stiffener 64 may include forward edge 66 and back edge 68 structured so that a cross section of stiffener 64 forms the C-shape between forward edge 66 and back edge 68. Stiffener 64 may be coupled with forward plate 84 at a forward curve 88 of the C-shape by way of a third weld joint 92, and at a rearward curve 90 of the C-shape by way of a fourth weld joint 94. Additionally, first weld joint 70, second weld joint 72, third weld joint 92, and fourth weld joint 94 may be parallel to one another so as to form a box configuration. The box configuration may be substantially rectangular as illustrated but might instead be trapezoidal, rhomboidal, or any other suitable shape. Further, forward plate 84 may be oriented substantially parallel to a middle segment 96 of the C-shape of stiffener 64 and coupled to roof section 54 at upper edge 50 by way of a fifth weld joint 98. Back plate 86 may be oriented diagonally relative to middle segment 96 and coupled to back section 42 by way of a sixth weld joint 100. In this configuration, forward plate 84 may be coupled to bucket shell 48 and stiffener 64 by fifth weld joint 98 and third weld joint 92, respectively, and stiffener 64 may be coupled to bucket shell 48 by first weld joint 70, with first weld joint 70, third weld joint 92, and fifth weld joint 98 forming a second box configuration. Back plate 86 may be coupled to bucket shell 48 and stiffener 64 by sixth weld joint 100 and fourth weld joint 94, respectively. Second weld joint 72, fourth weld joint 94, and sixth weld joint 100 may form a third box configuration. The second box configuration may substantially have the form of a square adjoining a right triangle, and the third box configuration may substantially have the form of a right triangle. Bucket shell 48 may be generally parallel to forward plate 84 as back section 42 approaches upper edge 50 before terminating at roof section 54. Roof section 54 may break parallel plane of back section 42 relative to roof section 54 before terminating at upper edge 50. In this configuration, roof section 54 forms an intersection with forward plate 84 at upper edge 50. In the present embodiment an angle formed by the intersection of roof section 54 and forward plate 84 may be about 90 degrees or less, and might be from about 30 degrees to about 90 degrees although the present disclosure is not thereby limited.

FIG. 6 further illustrates additional details relating to weld joints 70, 72, 92, 94, 98, 100. It can be seen from FIG. 6 that third weld joint 92 is positioned generally at an intersection of forward plate 84 and forward curve 88 of the C-shape, coupling forward plate 84 to stiffener 64. Fourth weld joint 94 is positioned generally at an intersection of back plate 86 and rearward curve 90 of stiffener 64, attaching back plate 86 to stiffener 64. Fifth weld joint 98 is positioned near upper edge 50, coupling roof section 54 of bucket shell 48 to forward plate 84. Sixth weld joint 100 is positioned at an intersection of back plate 86 and back section 42, attaching back plate 86 to back section 42. First, second, third, fourth, fifth, and sixth weld joints 70, 72, 92, 94, 98, 100 may each be formed by a single fillet weld or any other suitable type of weld.

INDUSTRIAL APPLICABILITY

Referring to the drawings generally, in a typical application machine 12 may be operated to drive into a pile of material with bucket 34 held at a generally horizontal digging position. Upon entering and/or during moving bucket 34 through the pile, implement system 10 may be operated to tilt bucket 34 from a digging position toward a racked position, such that captured material moves under the force of gravity, and forward travel of machine 12 and bucket 34, into the material-carrying volume of bucket 34. Loading bucket 34 in this general manner may, at times, result in asymmetric application of crowd and lifting forces to bucket 34. For example, a large boulder or chunk of ore or other material near or contacting one of right side wall 44 or left side wall 46, but not the other, or any of a variety of other phenomena can result in asymmetric or uneven forces that apply torsional to bucket 34 and associated components. As described herein, torque tube assembly 62 increases resistance to twisting of bucket 34 and torsional deflections generally, thereby preventing damage to bucket 34 or excessive wear and/or premature failure. As noted above, the C-shape form of stiffener 64 not only strengthens and stiffens bucket 34, but also enables associated weld joints that are shaped to distribute forces and thereby limit stress concentrations. Stiffener 64 may be welded to each side wall 44, 46, with each weld joint having generally the same C-shape as stiffener 64, and resulting in the weld joints being substantially free from tight angles or the like that might be present in other torque tube assemblies.

These general principals of implement system operation and bucket structural integrity are expected to be associated with improved operation by way of increased efficiency and/or increased service life or operational load capacity of a bucket and implement system, as each capture, lift, and dump cycle of machine 12 can move a greater quantity of material, at least for a given fuel burn, than certain earlier buckets with larger or more complex torsional stiffening structures or simply greater plate thicknesses. Moreover, the increased torsional stiffness and bucket strength as compared with other known bucket designs can reduce wear or stress on other machine components and in some instances improve still other factors such as wear symmetry and machine stability.

The present disclosure may also provide economic advantages over known buckets having relatively complex formed plates and numerous plug welds that can be labor-intensive to produce. Embodiments according to the present disclosure may be structured such that bucket shell 48 and torque tube assembly 62 form a continuous assembly 62, with bucket shell 48 positioned beneath torque tube assembly 63 and thereby eliminating the need for plug welds. As also noted above, many of the foregoing advantages and properties are expected to find application in relatively short, wide loader buckets used in underground mining applications, however, it will be appreciated that the present disclosure is not limited to any particular application.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. For instance, while torque tube assembly 62 is shown positioned adjacent to roof section 54 of bucket shell 48, alternative embodiments are contemplated where torque tube assembly 62 is lower down back section 42, or even mounted internally to bucket shell 48. Other aspects, features and advantages will be apparent upon examination of the attached drawings and appended claims.

What is claimed is:

1. A bucket for an implement system in a machine comprising:

a bucket shell having an upper edge extending laterally between a left side wall and a right side wall, a roof section extending rearward from the upper edge, a lower edge oriented substantially parallel to the upper edge, a floor section extending rearward from the lower edge, and a bad section connecting between the roof section and the floor section;

a plurality of mounting elements coupled to the back section of the bucket shell and structured for coupling the bucket to a linkage in the implement system; and a torque tube assembly including an elongate stiffener extending laterally between the left side wall and the right side wall, the stiffener including a forward edge attached to the back section of the bucket shell at a first weld joint and a back edge attached to the back section of the bucket shell at a second weld joint, and a cross section forming a C-shape between the forward edge and the back edge;

wherein the torque tube assembly further includes a forward plate connecting between the elongate stiffener and the roof section of the bucket shell, and a back plate connecting between the elongate stiffener and the back section of the bucket shell.

2. The bucket of claim 1 wherein the forward plate is attached to the elongate stiffener at a third weld joint and the back plate is attached to the elongate stiffener at a fourth weld joint, and wherein the first, second, third, and fourth weld joints are parallel with one another so as to form a box configuration.

3. The bucket of claim 2 wherein the bucket shell includes an inner surface forming a material-carrying volume, and an outer surface, and wherein the torque tube assembly is attached to the outer surface.

4. The bucket of claim 2 wherein the third weld joint attaches the forward plate to the elongate stiffener at a forward curve of the C-shape, and the fourth weld joint attaches the back plate to the elongate stiffener at a rearward curve of the C-shape.

5. The bucket of claim 2 wherein the forward plate is oriented substantially parallel to a middle segment of the C-shape, and the back plate is oriented diagonally relative to the middle segment of the C-shape.

6. The bucket of claim 2 wherein the box configuration includes a substantially rectangular box configuration.

7. The bucket of claim 6 wherein the forward plate is attached to the roof section of the bucket shell at a fifth weld joint so as to form a second box configuration with the first weld joint and the third weld joint, and the back plate is attached to the bucket shell at a sixth weld joint so as to form a third box configuration with the second weld joint and the fourth weld joint.

8. The bucket of claim 7 wherein the elongate stiffener is formed by a plurality of longitudinal stiffener segments in an alternating arrangement with the plurality of hinge plates.

9. The bucket of claim 8 wherein each of the forward plate and the back plate includes a plurality of longitudinal plate segments extending laterally between the left side wall and the right side wall, and each positioned in an alternating arrangement with the plurality of hinge plates.

10. The bucket of claim 2 further comprising a plurality of hinge plates attached to the bucket shell and having the plurality of mounting elements coupled therewith.

11. An implement system for a machine comprising:

a linkage;

a bucket including mounting elements coupling the bucket to the linkage, and the bucket being movable relative to the linkage between a racked position and a dump position;

the bucket further including a bucket shell having an upper edge extending laterally between a left side wall and a right side wall, a roof section extending rearward from the upper edge, a lower edge oriented substantially parallel to the upper edge, a floor section extending rearward from the lower edge, and a back section connecting between the roof section and the floor section and having the mounting elements located thereon;

the bucket further including a torque tube assembly including an elongate stiffener extending laterally between the left side wall and the right side wall, the stiffener including a forward edge attached to the back section of the bucket shell at a first weld joint and a back edge attached to the back section of the bucket shell at a second weld joint, and a cross section forming a C-shape between the forward edge and the back edge;

wherein the torque tube assembly further includes a forward plate connecting between the elongate stiffener and the roof section of the bucket shell, and a back plate connecting between the elongate stiffener and the back section of the bucket shell.

12. The system of claim 11 wherein the forward plate is attached to a forward curve of the C-shape, and the back plate is attached to a rearward curve of the C-shape.

13. The system of claim 11 wherein the elongate stiffener is formed by a plurality of longitudinal stiffener segments.

14. The system of claim 13 wherein the bucket further includes a plurality of hinge plates positioned in an alternating arrangement with the plurality of longitudinal stiffener segments.

15. The system of claim 14 wherein the plurality of hinge plates each include a first side and a second side welded to a first adjacent one of the plurality of longitudinal stiffener segments and to a second adjacent one of the plurality of longitudinal stiffener segments, respectively.

16. The system of claim 15 wherein the back section of the bucket shell has an indented profile, and the plurality of hinge plates are positioned at least partially within a cutout formed by the indented profile.

17. The system of claim 11 wherein the bucket defines a bucket height dimension and a bucket width dimension that is greater than the bucket height dimension, and wherein the linkage further includes a lift arm pivotably coupled to a first group of the plurality of mounting elements, and a tilt lever assembly pivotably coupled to the lift arm and to a second group of the plurality of mounting elements.

18. A machine comprising:

a frame;

an implement system coupled to the frame and including a linkage and a bucket coupled to the linkage;

the bucket including mounting elements coupling the bucket to the linkage, and the bucket being movable relative to the linkage between a racked position and a dump position;

the bucket further including a bucket shell having an upper edge extending laterally between a left side wall and a right side wall a roof section of extending rearward from the upper edge, a lower edge oriented substantially parallel to the upper edge, a floor section extending rearward from the lower edge, and a back section connecting between the roof section and the floor section and having the mounting elements located thereon;

the bucket further including a torque tube assembly having an elongate stiffener extending laterally between the left side wall and the right side wall, the stiffener including a forward edge attached to the back section of the bucket shell at a first weld joint and a back edge attached to the back section of the bucket shell at a second weld joint, and a cross section forming a C shape between the forward edge and the back edge;

wherein the torque tube assembly further includes a forward plate connecting between the elongate stiffener and the roof section of the bucket shell, and a back plate connecting between the elongate stiffener and the back section of the bucket shell.

* * * * *